US006657391B2

(12) United States Patent
Ding et al.

(10) Patent No.: US 6,657,391 B2
(45) Date of Patent: Dec. 2, 2003

(54) APPARATUS AND METHOD FOR ESTABLISHING A Q-FACTOR OF A CAVITY FOR AN ACCELERATOR

(75) Inventors: Xiaodong Ding, El Cerrito, CA (US); Chong Yao, Pacheco, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 113 days.

(21) Appl. No.: 10/072,768

(22) Filed: Feb. 7, 2002

(65) Prior Publication Data

US 2003/0146704 A1 Aug. 7, 2003

(51) Int. Cl.[7] ..... H01J 25/10
(52) U.S. Cl. ..... 315/5.41; 315/505
(58) Field of Search ..... 315/5.41, 5.39, 315/500, 501, 505, 507

(56) References Cited

U.S. PATENT DOCUMENTS

| | | | | | |
|---|---|---|---|---|---|
| 3,784,873 | A | * | 1/1974 | Tronc et al. | 315/5.41 |
| 3,796,906 | A | * | 3/1974 | Henry-Bezy et al. | 315/5.41 |
| 4,155,027 | A | * | 5/1979 | Schriber et al. | 315/5.41 |
| 4,988,919 | A | * | 1/1991 | Tanabe et al. | 315/5.41 |
| 4,998,073 | A | * | 3/1991 | Miyata et al. | 315/500 |
| 5,014,014 | A | * | 5/1991 | Swenson | 315/505 |
| 5,132,593 | A | * | 7/1992 | Nishihara | 315/5.41 |
| 5,376,893 | A | | 12/1994 | Etievant et al. | 315/501 |
| 5,434,420 | A | * | 7/1995 | McKeown et al. | 250/396 R |
| 5,739,731 | A | | 4/1998 | Hicks et al. | 333/17.1 |
| 5,742,633 | A | | 4/1998 | Stone et al. | 372/92 |
| 5,744,957 | A | | 4/1998 | Vaughan, Jr. | 324/318 |
| 5,929,567 | A | * | 7/1999 | Kang et al. | 315/5.39 |
| 6,131,386 | A | | 10/2000 | Trumble | 60/274 |
| 6,181,224 | B1 | | 1/2001 | Glinder | 333/208 |
| 6,366,021 | B1 | * | 4/2002 | Meddaugh et al. | 315/5.41 |
| 6,376,990 | B1 | * | 4/2002 | Allen et al. | 315/5.41 |
| 6,407,505 | B1 | * | 6/2002 | Bertsche | 315/5.41 |
| 6,465,957 | B1 | * | 10/2002 | Whitham et al. | 315/5.41 |
| 6,498,444 | B1 | * | 12/2002 | Hanna et al. | 315/500 |
| 6,593,696 | B2 | * | 7/2003 | Ding et al. | 315/5.41 |
| 2003/0030391 | A1 | * | 2/2003 | Hanna et al. | 315/505 |

OTHER PUBLICATIONS http://www.lbl.gov/MicroWorlds/ALSTool/ALS_Components/RFSystem/, RF System (5 pages) Download Dec. 26, 2001.

http://www.Ins.cornell.edu/pulic/CESR/SRF/BasicSRF/SRFBas12.html, Basics of SRF Cavities 1.2: "Basics of RF Superconductivity" (2 pages) Download Dec. 26, 2001.

http://www.Ins.cornell.edu/public/CESR/SRF/BasicSRF/SRFBas13.html, Basics of SRF Cavities 1.3: "Advantages of SRF Technology" (2 pages) Download Dec. 26, 2001.

http://www.Ins.cornell.edu/public/CESR/SRF/BasicSRF/SRFBas14.html, Basics of SRF Cavities 1.4: "Theoretical Potential of SRF Cavities" (page 1 of 2) Download Dec. 26, 2001.

http://www.Ins.Cornell.edu/public/CESR/SRF/BasicSRF/SRFBas11.html, Basics of SRF Cavities 1.1: "RF Cavities" (2 pages) Download Dec. 26, 2001.

http://www.laacgl.lanl.gov/laacg/c–on–line/descriptions/superfpc.html, Laacg Online Software Compendium, Description "SUPERFISH" (4 pages) Download Jan. 4, 2002.

* cited by examiner

*Primary Examiner*—Don Wong
*Assistant Examiner*—Thuy Vinh Tran

(57) ABSTRACT

A cavity for use in an accelerator is formed by an inner wall including at least two different materials. According to embodiments of the present invention, a portion of the structure forming the inner wall of the cavity includes a first material (e.g., copper) while another portion forming the inner wall of the cavity includes a second material (e.g., steel). Using different materials for different portions of the inner walls forming a cavity may cause different Q-factors for the cavity while the shape of the cavity remains constant.

27 Claims, 4 Drawing Sheets

APPARATUS AND METHOD FOR ESTABLISHING A Q-FACTOR OF A CAVITY FOR AN ACCELERATOR

FIELD OF THE INVENTION

The present invention relates to an apparatus and method and apparatus for designing a cavity for an accelerator and, more particularly, embodiments of the present invention relate to an apparatus and method for establishing the Q-factor of an RF cavity at a desired level.

BACKGROUND OF THE INVENTION

Particle accelerators have been used for a number of years in various applications. For example, one common and important application of particle accelerators is their use in medical radiation therapy devices. In such an application, an electron gun may be coupled to an input cavity of an accelerator (e.g., a linear accelerator) and provide a source of charged particles or a particle beam to the accelerator. The accelerator may include number of RF (radio frequency) cavities through which charged particles beam travel. Electric and magnetic fields present within the cavity and acting on the charged particles provide the acceleration. The distribution of fields in an RF cavity is primarily determined by the geometry of the RF cavity. The accelerator accelerates the charged particles to produce an accelerated output beam for use in medical radiation therapy. One or more RF cavities in the accelerator are used to couple power into the particle beam to increase its acceleration.

The quality factor (also referred to as Q-factor) of an RF cavity characterizes the quality of the cavity with respect to RF losses in the cavity. The Q-factor of an RF cavity is defined as $Q=\omega W/P_d$, where W is the maximum stored energy in the cavity, $\omega$ is the angular (resonant) frequency of the cavity, and $P_d$ is the power dissipated on the cavity inner wall per radian of the RF cycle. The maximum stored energy W in the cavity is determined by the cavity shape and volume while $P_d$ is determined by the resistivity and magnetic permeability of the material of the inner wall of the cavity.

An RF cavity having a high Q-factor is a more efficient user of RF power. Thus, for the same cavity shape and the same amount of RF power, the accelerating field produced in the cavity is higher in a cavity having a higher Q-factor. However, operational bandwidth of an RF cavity is inversely proportional to the cavities Q-factor. As a result, a cavity having a lower Q-factor can operate on a wider range of frequencies and may be more stable and less sensitive to input perturbations.

It would be advantageous to provide an apparatus and method overcame the drawbacks of the prior art and allowed for an RF cavity that provided a desired Q-factor for the cavity while enabling a desired field distribution for electron acceleration within the cavity.

SUMMARY

Embodiments of the present invention provide a method and apparatus for providing an RF cavity with a desired Q-factor and a desired electric and magnetic field distribution within the RF cavity. The cavity may be used in an accelerator, such as a linear accelerator. According to some embodiments of the present invention, different parts of the inner wall of the cavity may be comprised of different materials. For example, one portion of the inner wall of the cavity may be fabricated from or comprise copper while a different portion of the inner wall of the cavity may be fabricated from or comprise steel. Different types of steel having different magnetic permeabilities may create different Q-factors for the cavity. In addition, different positions, ratios or combination of different materials for the inner walls of the cavity may result in different Q-factors for the cavity, even though the electric and magnetic field distributions within the cavity may remain steady. Electric field characteristics and distributions within a cavity, as well as the stored energy in the cavity may be modeled or calculated using SUPERFISH code.

Additional objects, advantages, and novel features of the invention shall be set forth in part in the description that follows, and in part will become apparent to those skilled in the art upon examination of the following or may be learned by the practice of the invention.

According to some embodiments of the present invention, a cavity for a linear accelerator may include an inner wall forming a cavity that has an input aperture and an output aperture, wherein the inner wall includes a first portion that includes a first material and a second portion that includes a second material. In some embodiments, an apparatus for a linear accelerator may include a cavity formed, at whole or in part, by a first inner wall portion and a second inner wall portion, wherein the first inner wall portion comprises a first material, the second inner wall portion comprises a second material and the second inner wall portion forms an end plate. In some embodiments, an apparatus for use with a linear accelerator may include a plurality of cavities, wherein at least one of the plurality of cavities is formed, at least in part, by a first inner wall portion and a second inner wall portion, wherein the first inner wall portion comprises copper and the second inner wall portion comprises steel. In some embodiments, an apparatus for use with a linear accelerator may include a portion of a first metallic material; and a portion of a second metallic material coupled to the portion of a first metallic material to form a cavity having an input aperture and an output aperture.

According to some embodiments of the present invention, a method for establishing the Q-factor of a cavity for a linear accelerator may include constructing a cavity having a first inner wall portion and a second inner wall portion, wherein the first inner wall portion includes a first material and the second inner wall portion includes a second material that is different from the first material. In some embodiments, a method for determining configuration of a cavity for a linear accelerator may include determining an internal geometry for a cavity that produces a desired electron acceleration within the cavity when electrons are introduced into the cavity; determining a desired Q-factor for the cavity; and determining a position of a portion of a first material and a position of a portion of a second material for forming the cavity such that the cavity has the desired Q-factor and the internal geometry.

According to some embodiments of the present invention, a system for identifying a configuration of a cavity for a linear accelerator may include means for identifying an internal geometry for a cavity that produces a desired electron acceleration within the cavity when electrons are introduced into the cavity; means for identifying a desired Q-factor for the cavity; and means for identifying a position of a portion of a first material and a position of a portion of a second material for forming the cavity such that the cavity has the desired Q-factor and the internal geometry.

According to some embodiments of the present invention, a computer program product in a computer readable medium for identifying configuration of a cavity for a linear accelerator may include first instructions for identifying an internal geometry for a cavity that produces a desired electron acceleration within the cavity when electrons are introduced into the cavity; second instructions for identifying a desired Q-factor for the cavity; and third instructions for identifying a position of a portion of a first material and a position of a portion of a second material for forming the cavity such that the cavity has the desired Q-factor and the internal geometry.

With these and other advantages and features of the invention that will become hereinafter apparent, the nature of the invention may be more clearly understood by reference to the following detailed description of the invention, the appended claims and to the several drawings attached herein.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

DETAILED DESCRIPTION

Applicants have recognized that there is a need for an apparatus, method and computer code that facilitate design of a cavity having a desired Q-factor and a desired field distribution or electron acceleration for use in a linear accelerator. Embodiments of the present invention provide such capabilities, by providing a cavity or method of configuring a cavity comprising at least two materials (e.g., copper and steel) such that the cavity has the desired Q-factor and field distribution. These and other features will be discussed in further detail below, by describing an apparatus and processes according to embodiments of the invention.

The following description is provided to enable any person skilled in the art to make and use the invention and sets forth the best modes contemplated by the inventor for carrying out the invention. Various modifications, however, will remain readily apparent to those skilled in the art.

Figure 1:
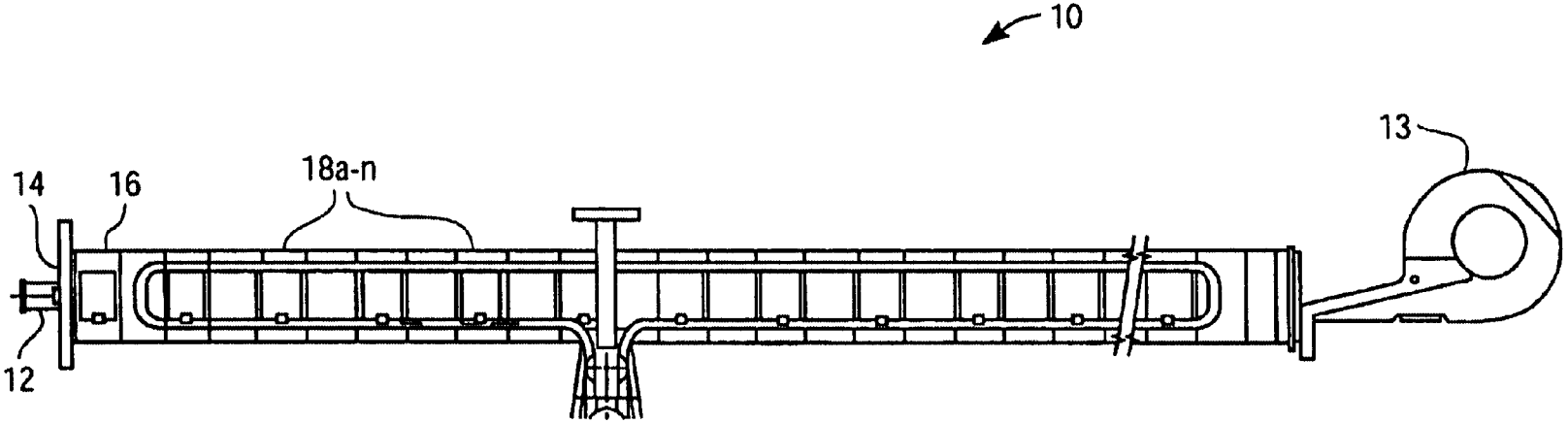
FIG. 1 is a cross-section of a linear accelerator in accordance with the embodiments of the present invention.

Referring first to FIG. 1, a block diagram of a standing-wave linear particle accelerator 10 according to one embodiment of the present invention is shown. As depicted in FIG. 1, the particle accelerator 10 is an elongated structure that includes both an input side and an output side. In operation, an electron gun 12 (or other particle injector) is typically coupled to the input side of the accelerator 10, while an accelerated particle beam is driven out of an output side, typically through a bending magnet structure 13 for delivery to a target or other device.

In a typical structure of an accelerator, as depicted in FIG. 1, the electron gun 12 is coupled via a flange 14 to a body 16 of accelerator 10. The accelerator 10 may include a number of accelerating cavities 18*a–n*. Charged particles, input into the accelerator 10 from electron gun 12 are bunched together in the first few accelerating cavities 18*a–n*. The bunch of charged particles will pass through each successive cavity during a time interval when the electric field intensity in that cavity is a maximum. One or more of the cavities may be shaped and tuned such that its resonant frequency ensures that the bunched electrons pass at the peak of intensity of each cavity. Thus, the particle beam of electrons or charged particles experiences and accelerating force along the axis of the cavities 18*a–n* due to the electromagnetic fields produced within the cavities 18*a–n*.

Figure 2:
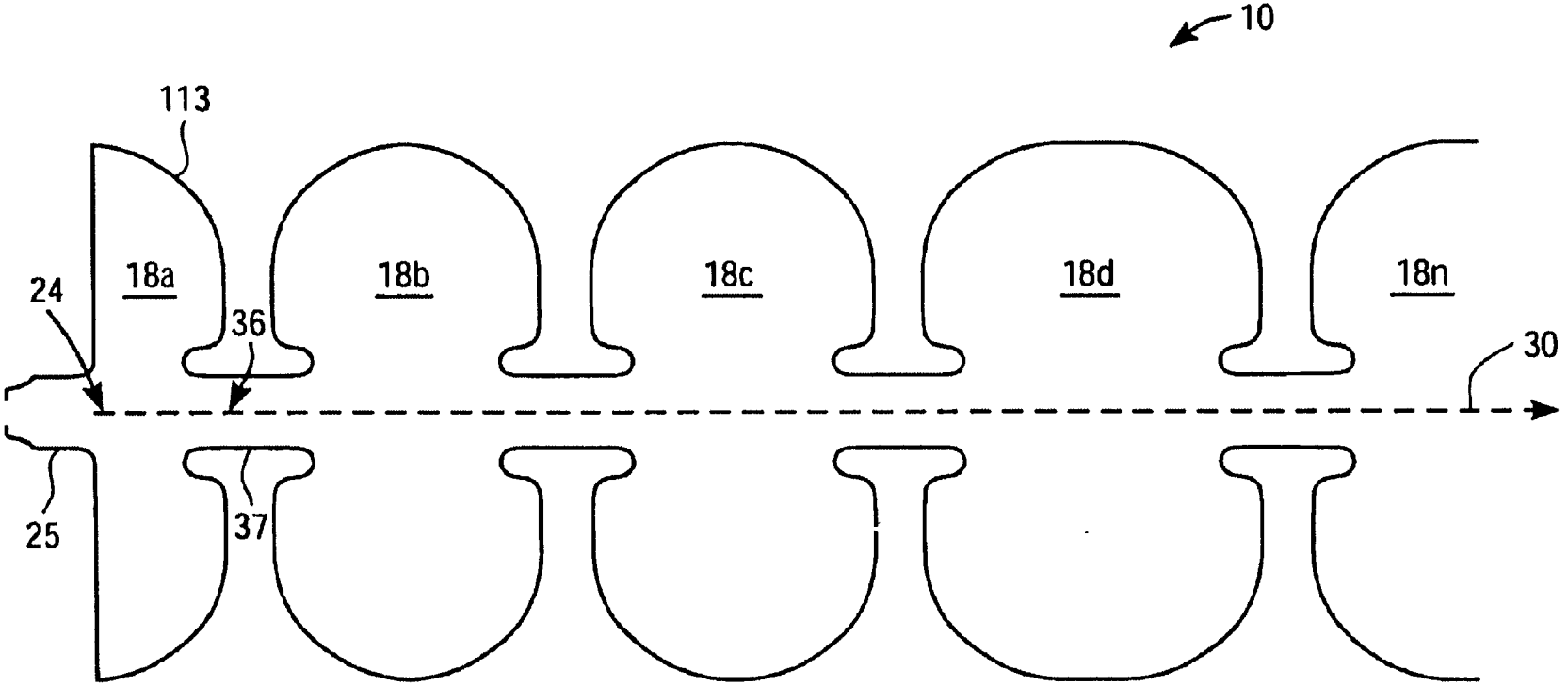
FIG. 2 is a partial cross-section depicting cavities of the accelerator of FIG. 1.

Referring now to FIG. 2, a partial cross-sectional view of cavities of a standing-wave linear particle accelerator 10 according to some embodiments of the present invention is shown. As depicted in FIG. 2, the accelerator 10 includes a number of accelerating cavities 18*a–n*. The cavities 18*a–n* may form the interior of a metallic structure comprising copper, steel, or a combination of both, as will be discussed in more detail below. In addition, the cavities 18*a–n* may be symmetric about a beam axis 30 of charged particles. The electrons or charged particles are accelerated through openings in each successive cavity along the beam axis 30, toward an output end of the accelerator 10. For example, the first cavity of accelerator 10 is a half cavity 18*a* which may abut a flange (not shown) and which may receive input particles from an electron gun (not shown) via an input aperture 24 formed by wall 25. Typical accelerators are formed such that several, if not all, of the cavities along beam axis 30 have approximately the same or similar size and shape (e.g., the same radius, same dimensions).

Figure 3:
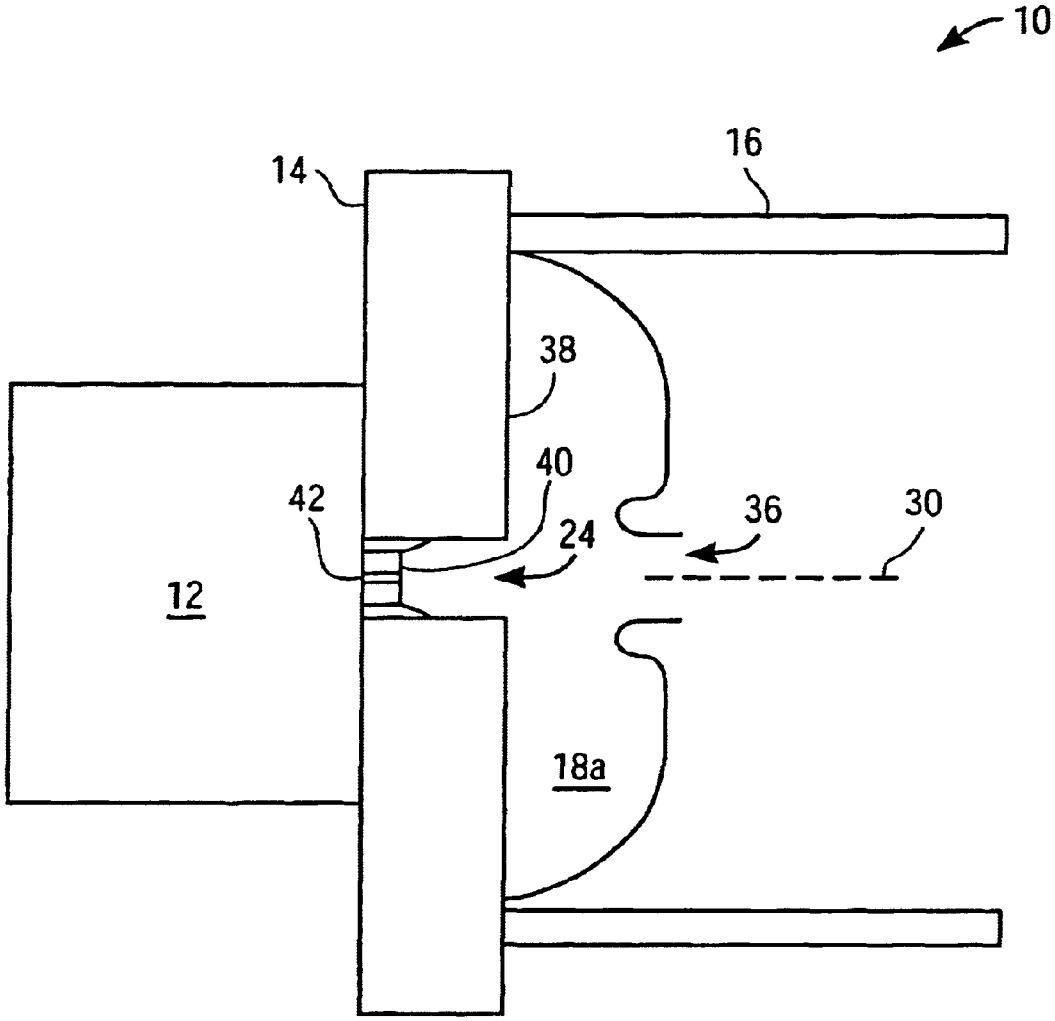
FIG. 3 is a partial cross-section of a first half-cavity usable with the accelerator of FIG. 1.

Referring now to FIG. 3, a partial cross-sectional view of one embodiment of a standing-wave linear particle accelerator 10 according some embodiments of the present invention is shown. In particular, FIG. 3 depicts an electron gun 12 coupled to a body 16 of accelerator 10 via a flange 14. A first half cavity 18*a* of accelerator 10 is shown. First half cavity 18*a* has an input aperture 24 formed by a wall 25 and an output aperture 36 formed by a wall 37. One side of first half cavity 18*a* is an anode plate 38 through which the input aperture 24. The input aperture 24 is positioned to receive electrons or other charged particles from the electron gun 12 as they are introduced into the cavity 18*a*. Generation and focusing of electrons may be assisted with an optional gun anode 40 having an anode aperture 42. The output aperture 36 couples and connects the wall 37 of the first half cavity 18*a* with another cavity 18*b*. The first half cavity 18*a* is formed to direct and focus charged particles along the beam path 30 through subsequent cavities (e.g., 18*b*, 18*c*) of the accelerator 10.

In some embodiments, to compensate for the change in shape of first half cavity 18*a*, dimensions of the anode plate 38 may be modified, thereby maintaining the ability to generate a focused and efficient beam of electrons or other charged particles without the need to modify the overall accelerator design. For example, in some embodiments, the size of the input aperture 24 of the anode plate 25 may be increased or different from the size of the output aperture 36. In some embodiments, thickness of the anode plate 38 may be increased (which may prevent RF fields from fringing into the electron gun 12).

Figure 4:
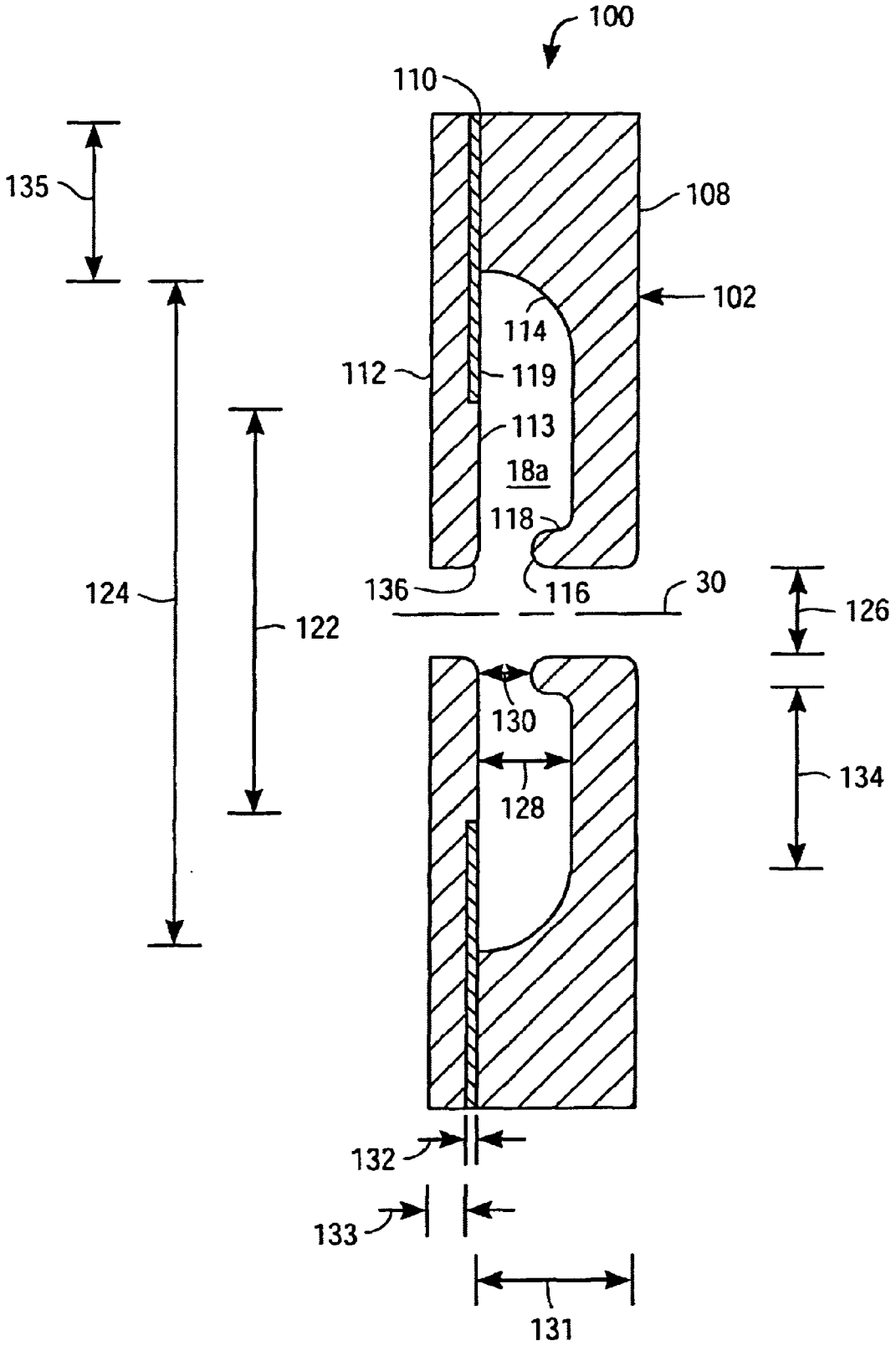
FIG. 4 is a cross-section of a first half-cavity usable with the accelerator of FIG. 1.

Referring now to FIG. 4, a cross-section of another example structure 100 forming a half cavity 18*a* is illustrated which may be used in accelerator 10, particular for an accelerator suitable for use in medical radiation therapy applications. The cavity 18*a* is formed as the interior of a metallic structure 102 that may be radially symmetric about the beam axis 30. In some embodiments, the structure 102 may be comprised of three parts or portions 108, 110, 112. In some embodiments, the portion 108 and the portion 110 may form a single component. For purposes of explanation, the portions 108 and 100 will collectively be referred to as the "nose" of the structure 102 while the portion 112 will be referred to as the "end plate" of the structure 102. In some embodiments, the potion 112 also may form some or all of an anode plate for the cavity 18*a*, some or all a flange (e.g., the flange 14) supporting the structure that forms the cavity 18*a*, or some or all of another component of the accelerator 10.

Pursuant to embodiments of the present invention, in some embodiments, the portions 108 and 110 may comprise one kind of material while the portion 112 may comprise a different kind of material. For example, the portions 108, 110 may comprise copper while the portion 110 may comprise steel. The portions 108, 110 and/or 112 may be joined or otherwise coupled in a variety of ways, such as by welding, bonding or brazing. As another example, some or all of the portions 108, 110, 112 of the structure 102 and/or the inner walls forming the cavity 18*a* may comprise superconductor(s), other metallic materials, alloy materials, etc. In some embodiments, the structure 102 may be created such that inner walls forming the cavity 18*a* are comprised of two or more different materials (e.g., copper, steel) while the remainder of the structure 102 is formed of a single material. Thus, the present invention allows for different materials to be used to create the inner walls that form the cavity 18*a*, while the remainder of the structure may have many different structures, configurations and material types. The present invention is not limited to how the structure 102 is formed and instead allows use of different materials to form the inner walls of the structure that create the cavity 18*a*. The arrangement of the portions 108, 110 and 112 are but one example of how inner walls comprising different materials may be created to form the cavity 18*a*, but the present invention is not limited to only the material types, configuration, design or arrangement illustrated in FIG. 4.

Using different materials to form the same interior cavity 18*a* allows of facilitates the creation of different Q-factors for the cavity 18*a*. More particularly, using different materials for the inner walls of the structure 102 that form the cavity 18*a* allow or facilitate the creation of different Q-factors for the cavity 18*a* while maintaining a desired electromagnetic field distribution within the cavity 18*a*. For example, the portion 112 of the structure 102 forms an inner wall 113 for the cavity 18*a* while the portion 108 of the structure 102 forms the inner walls 114, 116 and 118 of the cavity 18*a* and the portion 110 of the structure 102 forms the inner wall 119 for the cavity 18*a*.

If only copper is used to make the inner walls of the structure 102 to form the cavity 18*a*, the Q-factor for the cavity 18*a* may be so high that the bandwidth of the cavity 18*a* might be too narrow for stable operation of the cavity 18*a*. On the other hand, if steel is used to make the inner walls of the structure 102 to form the cavity 18*a*, the Q-factor of the cavity might be so low that the RF power fed into the cavity 18*a* may not be used efficiently.

As more specific examples, suppose the cavity 18*a* is formed by the structure 102 and has the following dimensions: 1.800 inches for the distance indicated by arrow 122, 2.968 inches for the distance indicated by arrow 124, 0.400 inches for the distance indicated by arrow 126, 0.400 inches for the distance indicated by arrow 128, 0.236 for the distance indicated by arrow 130, 1.9 inches for the distance indicated by arrows 131 (note, however, that this dimension is not illustrated in scale relative to the other dimensions and may vary widely depending on application), 0.050 inches for the distance indicated by arrows 132, 0.15 inches for the distance indicate by arrow 133, and 0.644 inches for the distance indicated by the arrow 134. As the distance indicated by arrow 135 has little impact on the operation of the cavity, such dimension may vary widely for purposes of manufacturing convenience, structural integrity, or other factor.

For purposes of the present invention, the statement that a dimension or measurement A is approximately equal to a dimension or measurement B includes, but is not limited to, situations where the dimension or measurement A is exactly equal to the dimension or measurement B. The curved or arced portions (e.g., 114, 116, 118, 136) of the interior wall of the structure 102 that form the cavity 102 may be or form portions of donut, toroid or frustum shaped surfaces for the walls forming the cavity 18*a* (or semi-circles or semicircular type edges on the cross-section view of the structure 102 illustrated in FIG. 4). For example, the semicircular arc forming the cross-section of the curved inner wall portion 114 may have a radius of 0.4 inches, the semicircular arc forming the cross-section of the curved inner wall portion 136 may have a radius of 0.14 inches, the semicircular arc forming the cross-section of the curved inner wall portion 116 may have a radius of 0.08 inches, and the semicircular arc forming the cross-section of the curved inner wall portion 118 may have a radius of approximately 0.08 inches. With these dimensions, the cavity 18*a* has a resonant frequency of approximately 2,998 MHz.

Applicants believe that the dimensions of the cavity 18*a* formed by the structure 102 play an important role in the operation of some embodiments of the present invention. In some embodiments the outer dimensions of the structure 102 may vary widely without significantly impacting the Q-factor of the cavity 18*a*. Also, full cavities (e.g., cavity 18*b*, cavity 18*c*) may be used in the accelerator 10 that use the same dimensions as does the cavity 18*a* albeit as adjusted for a full cavity as opposed to a half-cavity (i.e., the dimensions indicated by the arrows 128 and 130 may double).

For this example structure, if the portions 108, 110, 112 of the structure 102 may be made of copper having a resistivity of $1.7\times10^{-6}$ ohm-cm, the Q-factor of the cavity 18*a* is 6515. Alternatively, if the portions 108, 110, 112 of the structure 102 are all made of non-magnetic steel having a resistivity of $9.7\times10^{-6}$ ohm-cm, the Q-factor of the cavity 18*a* is 2764. If the portions 108, 110, 112 of the structure 102 are all made of magnetic steel having a (relative) permeability of 180, the Q-factor of the cavity 18*a* is 204. If the portions 108, 110, 112 of the structure 102 are all made of magnetic steel having a (relative) permeability of 1,800, the Q-factor of the cavity 18*a* is 65. Thus, different materials will result in different Q-factors. Note that magnetic steel can have a relative permeability that can be any number up to even the tens of thousands and many different material combinations and types can be used for the portions 108, 110 and/or 112 of the structure 102. For purposes of the present invention, a relative permeability of a material means the permeability (u) of the material relative to the permeability of free space ($u_0$) (i.e., $u/u_0$).

As opposed to using a single type of material for the structure 102 to form the cavity 18*a*, different portions of the structure may comprise different materials. For example, if the portion 112 of the structure 102 is formed of non-magnetic steel having a resistivity of $9.7\times10^{-6}$ ohm-cm and a (relative to free space) permeability of one while the portions 108, 110 of the structure are formed of copper having a resistivity of $1.7\times10^{-6}$ ohm-cm, the Q-factor of the cavity 18*a* is 4107. Alternatively, if the portion 112 of the structure 102 is formed of steel having a (relative to free space) permeability of 180 while the portions 108, 110 of the structure are formed of copper having a resistivity of $1.7\times10^{-6}$ ohm-cm, the Q-factor of the cavity 18*a* is 460 or approximately ten Gauss. On the other hand, if the portion 112 of the structure 102 is formed of steel having a (relative to free space) permeability of 1,800 while the portions 108, 110 of the structure are formed of copper having a resistivity of $1.7\times10^{-6}$ ohm-cm, the Q-factor of the cavity 18*a* is 149 or approximately ten thousand Gauss. Different ratios and positions of steel and copper portions for the inner walls of the structure 102 that form the cavity 18*a* may result in different Q-factors for the cavity 18*a* while the cavity retains the same or at least similar electromagnetic field distribution.

While each of the portions 108, 110, 112 are shown as being comprised of a single material, in some embodiments one or more of the portions 108, 110, 112 may be comprised of more than one material such that the inner wall portions 113, 114, 116, 118, 119, 120 and 136 forming the cavity 18*a* are comprised of steel or copper as described above while the remainder of one or more of the portions 108, 110, 112 may be comprised of one or more other materials. In such embodiments, the inner wall portions 113, 114, 116, 118, 119, 120, 136 preferably are at least the RF skin depth of the material, which in many applications may be approximately equal to 0.005 meters.

In some embodiments, a accelerator 10 may include a first cavity 18*a* formed of inner walls comprising different materials while one or more of the remaining cavities in the accelerator 10 may be formed by inner walls of the same material (e.g., copper). Alternatively, in some embodiments, the accelerator 10 may include a first cavity 18*a* formed of inner walls comprising different materials while one or more of the remaining cavities (e.g., cavity 18*b*) in the accelerator 10 may be formed by of from inner walls of different materials (e.g., copper and steel).

A method may be used to determine the proper positioning and ratio of one material versus a second material to form the cavity 18*a* and/or the structural relationships of different portions of different materials used to create the inner walls forming the cavity 18*a*, the structure 102, etc. For example, SUPERFISH code (or other accelerator modeling codes now known or later developed) may be used to determine optimal or at least good cavity geometry to obtain a desired electromagnetic field distribution and electron acceleration. In some embodiments, the desired electromagnetic field distribution and/or electron acceleration may be known or determined from the type of application (e.g., medical radiation therapy). Once the cavity geometry is known, variations in material types for the inner walls of the cavity 18*a* may be evaluated or tested to see if they provide a desired Q-factor. In some cases, the process of determining the proper positioning and/or ratio of two or more materials used to form the inner walls for the cavity 18*a* may be done in an iterative, trial and error, or multi-step approach until a final or acceptable configuration is determined or reached for the structure or portions forming the inner walls of the cavity 18*a*.

For example, in some embodiments, a method for establishing the Q-factor of a cavity for an accelerator may include constructing a cavity having a first inner wall portion and a second inner wall portion, wherein the first inner wall portion includes a first material and the second inner wall portion includes a second material that is different from the first material.

As another example, in some embodiments, a method for determining configuration of a cavity for an accelerator may include determining an internal geometry for a cavity that produces a desired electron acceleration within the cavity when electrons are introduced into the cavity (e.g., by analyzing cavity shapes and resulting field distributions using PARMELA and/or SUPERFISH code); determining a desired Q-factor for the cavity; and determining a position of a portion of a first material and a position of a portion of a second material for forming the cavity such that the cavity has the desired Q-factor and the internal geometry (e.g., by analyzing cavity configurations and resulting Q-factors using PARMELA and/or SUPERFISH code). In some embodiments, the method also may include constructing a cavity such that the cavity has the internal geometry and the desired Q-factor; determining the desired Q-factor for the cavity; determining the desired electron acceleration or field distribution for the cavity; etc. In some embodiments, the first material may be copper and the second material may be steel, as previously described above.

In some embodiments, determining a position and amount of a portion of a first material and a position and amount of a portion of a second material for forming the cavity such that the cavity has the desired Q-factor and the internal geometry may include adjusting dimensions of two portions of the cavity such that the internal geometry of the cavity remains constant or at least nearly constant while the relative portions, thicknesses, locations, sizes, material properties, etc. of the portions of cavity comprising the first material versus the portions of the cavity comprising the second material are varied, the physical characteristics of the different materials are varied, etc. For example, for the structure 102 illustrated in FIG. 4, the length of the inner wall portion 119 formed by the portion 110 may be shortened or enlarged, thereby adjusting the length of the wall portion 113 formed by the portion 112, to change the Q-factor of the cavity 18*a* while maintaining a constant dimension for the cavity 18*a* indicated by the arrow 124. Alternatively, or in addition, the properties (e.g., permeability, resistivity) of one or more of the structural portions 108, 110 and/or 112 may be changed to change the Q-factor of the cavity 18*a* while the geometry of the cavity 18*a* remains constant. As another example, the width of the portion 110 indicated by the arrow 132 may be adjusted (e.g., widened or narrowed) and the dimensions of the portion 110 and/or 108 may be adjusted accordingly or in a complementary way such that geometry of the cavity 18*a* remains constant. Thus, in some embodiments, determining a position of a portion of a first material (e.g., copper) and a position of a portion of a second material (e.g. steel) for forming said cavity such that said cavity has said desired Q-factor and said internal geometry may include replacing a portion of an inner wall forming the cavity and made from the first material with a portion of the second material. In addition, in some embodiments, the method may include calculating or otherwise determining a desired Q-factor for a cavity when the cavity is formed by inner walls comprising only a first material (e.g., copper) and then replacing portions of the inner walls with another material (e.g., steel) and again determining the Q-factor of the cavity. The process may be repeated with various portions of the inner walls forming the cavity created from different materials until the desired Q-factor is reached.

As another example of how a position and amount of a portion of a first material and a position and amount of a portion of a second material for forming a cavity such that the cavity has the desired Q-factor and the internal geometry, the Q-factor of a cavity may be calculated or modeled for a given internal geometry (e.g., an internal geometry that provides a desired field distribution and/or electron acceleration within the cavity) where all the inner walls a structure, or even the entire structure itself, that form the cavity are made of copper. Different portions of the cavity may then be modeled using steel and the material properties (e.g., permeability) of the steel may be varied until the desired Q-factor is reached. Typically, when RF power is feed into a cavity, electric surface currents will be created or induced on the inner walls forming the cavity. Different portions of the inner walls forming the cavity may have different levels of electric surface currents. Replacing a portion of the copper inner wall with steel material where the surface currents are higher relative to other portions of the copper inner wall generally will lower or otherwise impact the Q-factor of the cavity greater than replacing the other portions of the copper inner wall. In some embodiments, manufacturing and other concerns may dictate, suggest or otherwise limit which parts of the copper structure forming the inner wall for the cavity can be replaced with other material (e.g. steel). Once a portion of copper material is replaced with steel material, the Q-factor of the cavity can be calculated and modeled again. If the desired Q-factor is not obtained, the size, position, and/or material properties of the replacement portion can be changed again until the desired Q-factor is obtained.

Some embodiments of the present invention may be embodied as a computer program developed using an object oriented language that allows the modeling of complex systems with modular objects to create abstractions that are representative of real world, physical objects and their interrelationships. However, it would be understood by one of ordinary skill in the art that the invention as described herein could be implemented in many different ways using a wide range of programming techniques as well as general-purpose hardware systems or dedicated controllers. In addition, many, if not all, of the steps for the methods described above are optional or can be combined or performed in one or more alternative orders or sequences without departing from the scope of the present invention and the claims should not be construed as being limited to any particular order or sequence, unless specifically indicated.

Each of the methods described above can be performed on a single computer, computer system, microprocessor, or other device. For example, a conventional personal computer or workstation with sufficient memory and processing capability may be used as the device to implement the methods described herein. As a more specific example, a device used to implement the methods described herein may include a processor, microchip, central processing unit, or computer that is in communication with or otherwise uses or includes one or more communication ports for communicating with user devices and/or other devices. Communication ports may include such things as local area network adapters, wireless communication devices, Bluetooth technology, etc. The device also may include an internal clock element to maintain an accurate time and date for the device create time stamps for communications received or sent by the server device, etc. If desired, the device also may include one or more output devices such as a printer, infrared or other transmitter, antenna, audio speaker, display screen or monitor, text to speech converter, etc., as well as one or more input devices such as a bar code reader or other optical scanner, infrared or other receiver, antenna, magnetic stripe reader, image scanner, roller ball, touch pad, joystick, touch screen, microphone, computer keyboard, computer mouse, etc. In addition to the above, the device may include a memory or data storage device to store information, software, databases, accelerator information, communications, device drivers, cavity configurations, desired Q-factor information, desired field distribution or electron acceleration information, etc. The memory or data storage device may comprise an appropriate combination of magnetic, optical and/or semiconductor memory, and may include, for example, Random Read-Only Memory (ROM), Random Access Memory (RAM), a tape drive, flash memory, a floppy disk drive, a Zip™ disk drive, a compact disc and/or a hard disk.

The device's processor and data storage device each may be, for example: (i) located entirely within a single computer or other computing device; or (ii) connected to each other by a remote communication medium, such as a serial port cable, telephone line or radio frequency transceiver. A Pentium™ microprocessor such as the Pentium III™ or IV™ microprocessor, manufactured by Intel Corporation may be used for the processor 250. Equivalent or alternative processors are available from Motorola, Inc., AMD, or Sun Microsystems, Inc. Software may be resident and operating or operational on the server device and may be stored on a data storage device. The software may include a control program for operating the device. The device's processor may perform instructions of the control program, and thereby operate in accordance with the present invention, and particularly in accordance with the methods described in detail herein. The control program may be stored in a compressed, uncompiled and/or encrypted format and may include program elements that may be necessary, such as an operating system, a database management system and device drivers for allowing the device's processor to interface with peripheral devices, databases, etc. Appropriate program elements are known to those skilled in the art, and need not be described in detail herein.

Two or more of the steps in each of the methods described above could be performed on two or more different computers, computer systems, microprocessors, other means, etc., some or all of which may be locally or remotely configured. The methods can be implemented in any sort or implementation of computer software, program, sets of instructions, code, ASIC, or specially designed chips, logic gates, or other hardware structured to directly effect or implement such software, programs, sets of instructions or code. The computer software, program, sets of instructions or code can be storable, writeable, or savable on any computer usable or readable media or other program storage device or media such as a floppy or other magnetic or optical disk, magnetic or optical tape, CD-ROM, DVD, punch cards, paper tape, hard disk drive, Zip™ disk, flash or optical memory card, microprocessor, solid state memory device, RAM, EPROM, or ROM. For example, a computer program product in a computer readable medium for identifying configuration of a cavity for a linear accelerator may include first instructions for identifying an internal geometry for a cavity that produces a desired electron acceleration within the cavity when electrons are introduced into the cavity; second instructions for identifying a desired Q-factor for the cavity; and third instructions for identifying a position of a portion of a first material and a position of a portion of a second material for forming the cavity such that the cavity has the desired Q-factor and the internal geometry. In alternative embodiments, hard-wired circuitry may be used in place of, or in combination with, software instructions for implementation of some or all of the methods described herein. Thus, embodiments of the present invention are not limited to any specific combination of hardware and software.

Although the present invention has been described with respect to various embodiments thereof, those skilled in the art will note that various substitutions may be made to those embodiments described herein without departing from the spirit and scope of the present invention.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

The embodiments of the invention in which an exclusive property or privilege is claimed are defined as follows:

1. An apparatus for an accelerator comprising an inner wall forming a cavity that has an input aperture and an output aperture, wherein said inner wall includes a first portion that includes a first material and a second portion that includes a second material.

2. The apparatus of claim 1, wherein said first material is copper.

3. The apparatus of claim 1, wherein said second material is steel.

4. The apparatus of claim 3, wherein said second material has a relative permeability that is greater than 150 and less than 200.

5. The apparatus of claim 3, wherein said second material has a relative permeability that is approximately equal to 180.

6. The apparatus of claim 3, wherein said second material has a relative permeability that is greater than 1500 and less than 2000.

7. The apparatus of claim 3, wherein said second material has a relative permeability that is approximately equal to 1800.

8. The apparatus of claim 3, wherein said second material has a relative permeability that is approximately equal to one.

9. The apparatus of claim 3, wherein said second material has a resistivity that is approximately equal to $9.7\times10^{-6}$ ohm-cm.

10. The apparatus of claim 3, wherein said first material is copper.

11. The apparatus of claim 3, wherein said first material has a resistivity less than $2.0\times10^{-6}$ ohm-cm.

12. The apparatus of claim 1, wherein said first material has a resistivity less than a resistivity of said second material.

13. The apparatus of claim 1, wherein said second portion forms part of an end plate.

14. An apparatus for an accelerator comprising a cavity formed, at least in part, by a first inner wall portion and a second inner wall portion, wherein said first inner wall portion comprises a first material, said second inner wall portion comprises a second material and said second inner wall portion forms an end plate.

15. The apparatus of claim 14, wherein said first material is copper.

16. The apparatus of claim 15, wherein said second material is steel.

17. An apparatus for use with an accelerator comprising a plurality of cavities, wherein at least one of said plurality of cavities has a first inner wall portion and a second inner wall portion, wherein said first inner wall portion comprises copper and said second inner wall portion comprises steel.

18. The apparatus of claim 17, wherein at least one of said plurality of cavities includes an end plate and said at least one of said plurality of cavities' second inner wall portion forms part of said end plate.

19. An apparatus for use with an accelerator, comprising:

a portion of a first metallic material; and a portion of a second metallic material coupled to said portion of a first metallic material to form a cavity having an input aperture and an output aperture.

20. The apparatus of claim 19, wherein said portion of a first metallic material comprises copper and said portion of a second metallic material comprises steel.

21. A method for establishing a Q-factor of a cavity for an accelerator comprising:

constructing a cavity having a first inner wall portion and a second inner wall portion, wherein said first inner wall portion includes a first material and said second inner wall portion includes a second material that is different from said first material.

22. A method for determining a configuration of a cavity for an accelerator, comprising:

determining an internal geometry for said cavity that produces a desired electron acceleration within said cavity when electrons are introduced into said cavity;

determining a desired Q-factor for said cavity; and determining a position of a portion of a first material and a position of a portion of a second material for forming said cavity such that said cavity has said desired Q-factor and said internal geometry.

23. The method of claim 22, further comprising:

constructing said cavity such that said cavity has said internal geometry and said desired Q-factor.

24. The method of claim 22, wherein said first material is copper and said second material is steel.

25. The method of claim 22, further comprising:

determining a Q-factor for said cavity when said cavity is formed by inner walls comprising only said first material.

26. The method of claim 22, wherein said determining a position of a portion of a first material and a position of a portion of a second material for forming said cavity such that said cavity has said desired Q-factor and said internal geometry includes replacing a portion of an inner wall made from said first material and forming said cavity with a portion of said second material.

27. A computer program product in a computer readable medium for identifying configuration of a cavity for an accelerator, comprising:

first instructions for identifying an internal geometry for said cavity that produces a desired electron acceleration within said cavity when electrons are introduced into said cavity;

second instructions for identifying a desired Q-factor for said cavity; and third instructions for identifying a position of a portion of a first material and a position of a portion of a second material for forming said cavity such that said cavity has said desired Q-factor and said internal geometry.

* * * * *